US009228703B2

(12) United States Patent
Killion

(10) Patent No.: US 9,228,703 B2
(45) Date of Patent: Jan. 5, 2016

(54) SOFT FLASHLIGHT

(75) Inventor: Thomas Killion, Indianapolis, IN (US)

(73) Assignee: Thomas Killion, Indianapolis, IN (US)

( * ) Notice: Subject to any disclaimer, the term of this patent is extended or adjusted under 35 U.S.C. 154(b) by 0 days.

(21) Appl. No.: 13/399,695

(22) Filed: Feb. 17, 2012

(65) Prior Publication Data

US 2013/0215608 A1 Aug. 22, 2013

Related U.S. Application Data

(60) Provisional application No. 61/463,478, filed on Feb. 18, 2011.

(51) Int. Cl.

| | |
|---|---|
| ***F21L 4/00*** | (2006.01) |
| ***F21L 4/02*** | (2006.01) |
| *F21Y 101/02* | (2006.01) |

(52) U.S. Cl.

CPC ..... *F21L 4/005* (2013.01); *F21L 4/022* (2013.01); *F21L 4/027* (2013.01); *F21Y 2101/02* (2013.01)

(58) Field of Classification Search

CPC ..... F21L 4/00; F21L 4/005; F21L 4/02; F21L 4/022; F21L 4/027; F21L 15/08

USPC ..... 362/189, 196, 198, 200–202, 204

See application file for complete search history.

(56) References Cited

U.S. PATENT DOCUMENTS

| | | | | |
|---|---|---|---|---|
| 4,399,495 | A | 8/1983 | Leopoldi et al. | |
| D376,690 | S * | 12/1996 | Lockerby | D3/284 |
| D425,231 | S | 5/2000 | Lynch et al. | |
| 6,132,064 | A * | 10/2000 | Bear | 362/259 |
| 6,301,484 | B1 | 10/2001 | Rogers et al. | |
| 6,435,695 | B1 * | 8/2002 | Altman | 362/189 |
| 6,454,435 | B1 * | 9/2002 | Altman | 362/200 |
| 6,626,019 | B1 * | 9/2003 | Huang | 70/456 R |
| 6,773,191 | B2 | 8/2004 | Killion | |
| D524,972 | S | 7/2006 | Shiu | |
| 7,147,344 | B2 * | 12/2006 | Parsons | 362/205 |
| D549,862 | S | 8/2007 | Lee | |
| 7,499,699 | B2 | 3/2009 | Rodriguez et al. | |
| D627,092 | S | 11/2010 | Puglisi | |

(Continued)

OTHER PUBLICATIONS

SmashLight, Dec. 23, 2011, bentcil.com, pp. 1-2; http://web.archive.org/web/20111223105135/http://www.bentcil.com/britelights/smashlight.*

(Continued)

*Primary Examiner* — Diane Lee
*Assistant Examiner* — Kenny C Sokolowski
(74) *Attorney, Agent, or Firm* — E. Victor Idiano; Indiano Law Group, LLC

(57) ABSTRACT

A flashlight includes a core having first and second surfaces, a side edge portion, and proximal and distal ends; along with first, second and third cavities. Light generating components include a light emitter in the first cavity, a switch in the second cavity and a battery disposed in the third cavity. A ribbon cable electrically couples the switch and battery. A first sheet-like stiffener overlays the first surface of the core. A first cover sheet overlays the first sheet-like stiffener to sandwich the sheet like stiffener between the first surface of the core and the first cover sheet. A second cover sheet overlays the second surface of the core. The first and second cover sheet members are joined together to form a flexible casing having an interior cavity. The core stiffener and light generating components are disposed within the interior cavity.

19 Claims, 4 Drawing Sheets

(56) References Cited

U.S. PATENT DOCUMENTS

| | | | | |
|---|---|---|---|---|
| D636,509 | S | 4/2011 | Killion et al. | |
| D636,510 | S | 4/2011 | Killion et al. | |
| 2003/0081416 | A1* | 5/2003 | Hsu | 362/249 |
| 2007/0190995 | A1 | 8/2007 | Wang et al. | |
| 2010/0110670 | A1 | 5/2010 | Werth et al. | |

OTHER PUBLICATIONS

Photographs of the interior components of an Eliana soft flashlight sold by the Killion Corp and shown for sale on www.Bentcil.com at least as early as Feb. 14, 2009.
Bentcil.com excerpts Feb. 14, 2009.

* cited by examiner

SOFT FLASHLIGHT

I. CLAIM OF BENEFIT TO PROVISIONAL APPLICATION

The instant application claims the benefit of a priority to Thomas Killion. U.S. Provisional Patent Application Ser. No. 61/463,478 filed on 18 Feb. 2011, which is fully incorporated herein by reference.

II. TECHNICAL FIELD OF THE INVENTION

The present invention relates to flashlights, and more particularly, to a "soft flashlight", that is characterized generally by having a flexible, sheet-like material casing, rather than the more typical rigid, thicker plastic or metal casing.

III. BACKGROUND OF INVENTION

Traditional flashlights usually include a housing that comprises a generally cylindrical casing, having a hollow interior into which batteries are received.

In order to provide strength to the flashlight, and protect the batteries, the casing is normally made from a hard, rigid plastic or metal material. Battery contacts and wiring are disposed within the interior of the hard plastic casing.

One end of the casing is typically closed, and the other end of the casing is open. The open end of the casing often includes a threaded end surface for threadedly receiving a light assembly, that when joined to the casing forms a part of the overall flashlight housing. The light assembly includes an axially facing, radially extending lens cover, that covers over a highly reflective parabolic or conical dish. The dish includes a light bulb placed at the base of the dish.

A switch member is usually mounted on the outwardly facing, cylindrical side surface of the flashlight. Typically, either a push button-type switch or a slide switch is employed to enable the user to turn the light on and off. Examples of such flashlights are shown in Shiu. U.S. Pat. No. D524,972; Lynch, U.S. Pat. No. D425,231; and Leopoldi, U.S. Pat. No. 4,399,495.

Flashlights of this type have been produced in many sizes and shapes and have been used for many years, and are still in widespread use. Although such flashlights are often large and cumbersome, they have significant utility because the size of the interior of the rigid casing can be made large enough to hold a plurality (e.g. 2-5) of large batteries, such as C or D cells, to provide the flashlight with sufficient candle power (or lumen) to cast a bright light on the surrounding areas, and sufficient power reserves to produce light for relatively long periods of time. Because of this large battery capacity, flashlights of this type are often used in work and safety-related applications and are often carried by police officers and other security and safety personnel. Additionally, the Applicant has been an inventor in the field of flashlights and other lighted devices. See, Killion, U.S. Pat. No. 6,773,991; Killion et al., U.S. Pat. No. D636,509; Killion et al., U.S. Pat. No. D636,510; and Killion, Published Patent Application No. 2010/0110670 A1.

Although the rigid casing of the flashlights described above are usually cylindrical, advances in battery and light bulb technology have permitted designers to expand beyond the confinement of typically employed cylindrical shapes. For example, a large number of "flat casing" flashlights exist that employ more compact batteries and advanced technology bulbs such as LED bulbs. See, e.g. Lee, U.S. Pat. No. D549,862.

Recently, "soft flashlights" have begun to be used in several applications. As used in this application, a soft flashlight is a flashlight that has a non-rigid easing. The casing on a soft flashlight generally includes a pair of plastic sheet-like members that are joined together to serve as its outer casing, rather than a hard rigid plastic covering. Another typical feature of soft flashlights is that they are generally thin and somewhat sheet-like in their configuration rather than being cylindrical. More accurately, such soft flashlights might comprise thickened sheet sandwiches.

A typical soft flashlight includes a first sheet member that serves as the top cover member, and a second sheet member that serves as a bottom sheet member. The top and bottom sheet-like members are usually coupled to each other around the edges, so as to form an interior pocket there between. Functional elements (e.g. bulbs, light assembly, switches, batteries) are disposed in the pocket formed between the first and second cover members.

The interior components that are inserted within the pocket typically include a battery for power, a switch to enable the user to turn the flashlight on and off and a light source. The recent popularization of LED type light bulbs has facilitated the use of such soft flashlights because of the low power usage, and bright light provided by such LEDs. The bright light and low power usage of LEDs has generally made such lights practical, as such lights are usually powered by a small disc-like battery, of the type that one might find in an automobile key fob, garage door remote control or calculator.

One valuable feature of such "soft flashlights" is that they can be made relatively inexpensively. This inexpensive nature makes these flashlights ideally suited for use as promotional products. Promotional products are products that serve both a functional purpose, and also include advertising to serve an advertising purpose. Examples of well-known promotional products include things such as coffee cups that will often hear the name of a particular company. A wide variety of the promotional products can be found at the Applicant's website at www.benteil.com, that shows, inter alia, a wide variety of pens, clips, magnets and lighted products.

Another feature of the soft flashlights is that they may be constructed to be quite small and inexpensive. As such, soft flashlights work well when attached to key chains, and when carried in purses, as they are quite compact, while still being capable of providing a significant amount of light.

Although known soft flashlights do have several valuable features, they also have some drawbacks. One drawback with several known flashlights is that they tend to be too flexible and "squishy" feeling and lack in any significant rigidity. This excess flexibility enables the flashlight to be bent along an axis that is perpendicular to the longitudinal axis of the device. One problem with this high flexibility is that it imparts an unstable, and therefore undesirable feel to the device.

Therefore, one object of the present invention is to provide a stiffer, less flexible, soft flashlight than those that are presently known, that will have increased rigidity, and therefore tend to have a better "feel", and that can also impart a better and wider pressure point for the on/off switching device to thereby make the switch for the device easier to activate through this wider pressure point.

Another difficulty with prior known soft flashlights relates to the wiring. In particular, the electrical components of known soft flashlights are usually wired together through the use of round (in cross section) wires that couple the battery to the LED light. These traditional round wires have several drawbacks. One drawback is that round wires can import a had "feel" to the flashlight as they make the flashlight devices in which they are used seem somewhat lumpy. In order to alleviate this "lumpy feel," prior art flashlights employed a tunnel that was formed into the foam core of the device into which the round wires were placed.

Another difficulty encountered with the use of typical round wires is that they are difficult to manipulate and attach to appropriate components during manufacture. A further difficulty that is often encountered is that traditional round wires are difficult to attach to other small components such as a battery and switch. Although one can be assured of getting a good connection to the battery by soldering the wires to the battery, soldering suffers from the down side of causing the battery to have an unpleasant feeling or bump.

Alternately, wires may be coupled to a battery terminal via tape. Although the use of tape reduces the size of the "bump", it is difficult to ensure that one achieves a good and durable connection between the wire and the batteries when tape is used.

Another problem with the use of round wires is that such wires often have sharp edges. These sharp edges have the capability of piercing the soft plastic sheet-like covers of the soft flashlight, thereby detracting from the feel of the device, and possibly causing some discomfort to the user if the user gets pricked by the wires' sharp edge.

Therefore, one object of the present invention is to provide a soft-type flashlight having an improved wiring system.

III. SUMMARY OF THE INVENTION

In accordance with the present invention, a flashlight comprises a relatively thickened core member including a first surface, a second surface, a side edge portion, a proximal end and a distal end. The core also includes a first cavity, a second cavity and a third cavity. A plurality of light generating components are provided that include a light emitter disposed in the first cavity, a switch disposed in the second cavity and a battery. The battery is disposed in the third cavity. A ribbon cable is provided for electrically coupling the light emitter, switch and battery. A first sheet-like stiffener is provided for overlaying the first surface of the core member. A first cover sheet member is provided for overlaying the first sheet-like stiffener to sandwich the first sheet like stiffener between the first surface of the core member and the first cover member. A second cover member is provided for overlaying the second surface of the core member. The first and second cover members are joined together to form a flexible casing having an interior cavity. The core member, stiffener and light generating components are disposed within the interior cavity of the flashlight.

In a preferred embodiment of the present invention, the core member has a thickness, the battery has a thickness and the thickness of the core member is generally at least as great as the thickness of the battery. Further, the third cavity has a depth, and the battery has a thickness, wherein the depth of the third cavity is generally at least as great as the thickness of the battery. More preferably, the third cavity has a depth, and the core has a thickness that are sufficient to permit the first stiffener to rest upon the first surface of the core member and planarly extend over the third cavity, when the battery is disposed in the third cavity.

This feature has several advantages. By properly sizing the core, the cavity, and the battery, one can have a flashlight with a smooth feeling top, that does not feel lumpy. This smooth feeling top contributes to the overall perceived aesthetic value and overall quality of the device.

In another preferred embodiment, the ribbon cable comprises a first ribbon cable that extends between and electrically couples the battery to the switch. The second ribbon cable extends between and electrically couples the battery and the light emitter. A third ribbon cable is also employed that extends between and electrically couples the switch and the light emitter. The ribbon cable preferably comprises a bendable metal strip and most preferably, a bendable foil strip.

One feature of the present invention is that a ribbon-like conductor is used in lieu of round wires. The ribbon-like connector has the advantage of not providing the unpleasant touch experience associated with the "bump" found with round wires. Additionally, the conductor has the advantage of being generally easier to connect to each of the battery, switch and lighting elements than wire-like devices.

These and other features of the present invention will become apparent to those skilled in the art upon a review of the detailed description and drawings, that is believed to be the best mode of practicing the invention perceived presently by the Applicant.

IV. BRIEF DESCRIPTION OF THE DRAWINGS

VI. DETAILED DESCRIPTION

Figure 1:
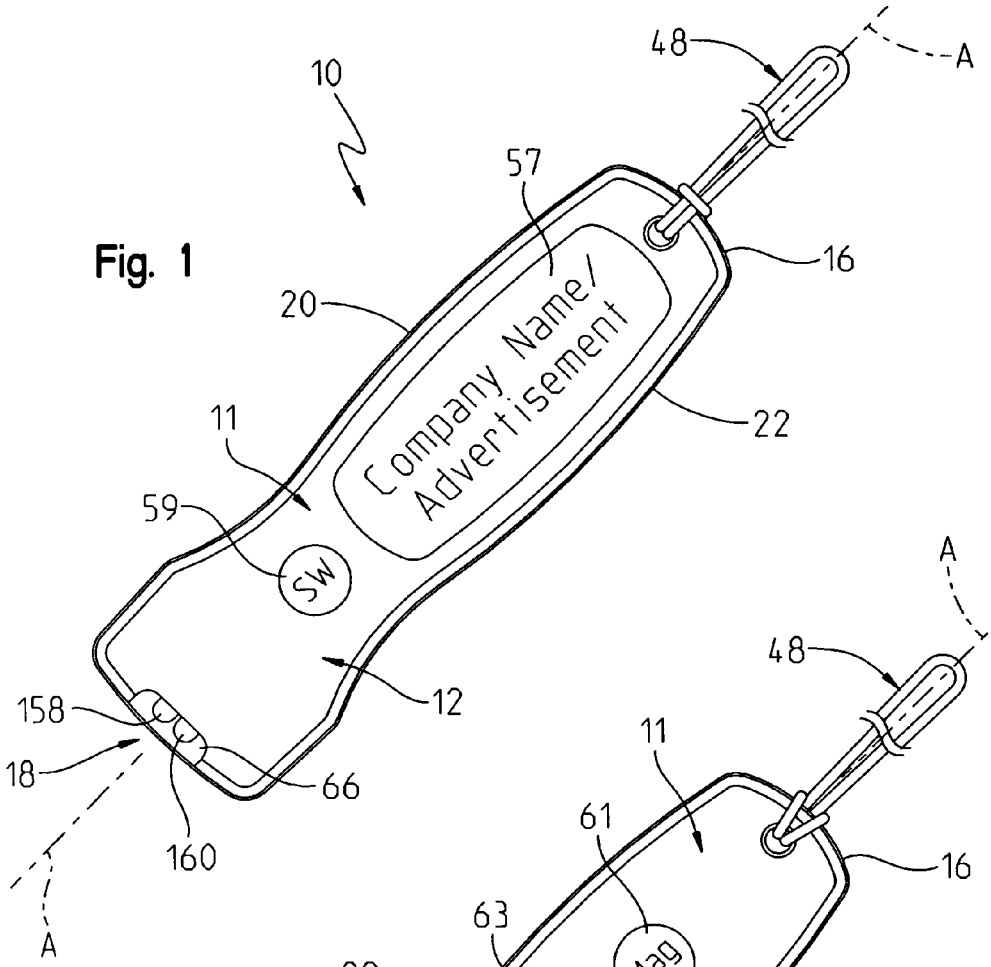
FIG. 1 is a perspective top side view of the flashlight of the present invention.
Figure 2:
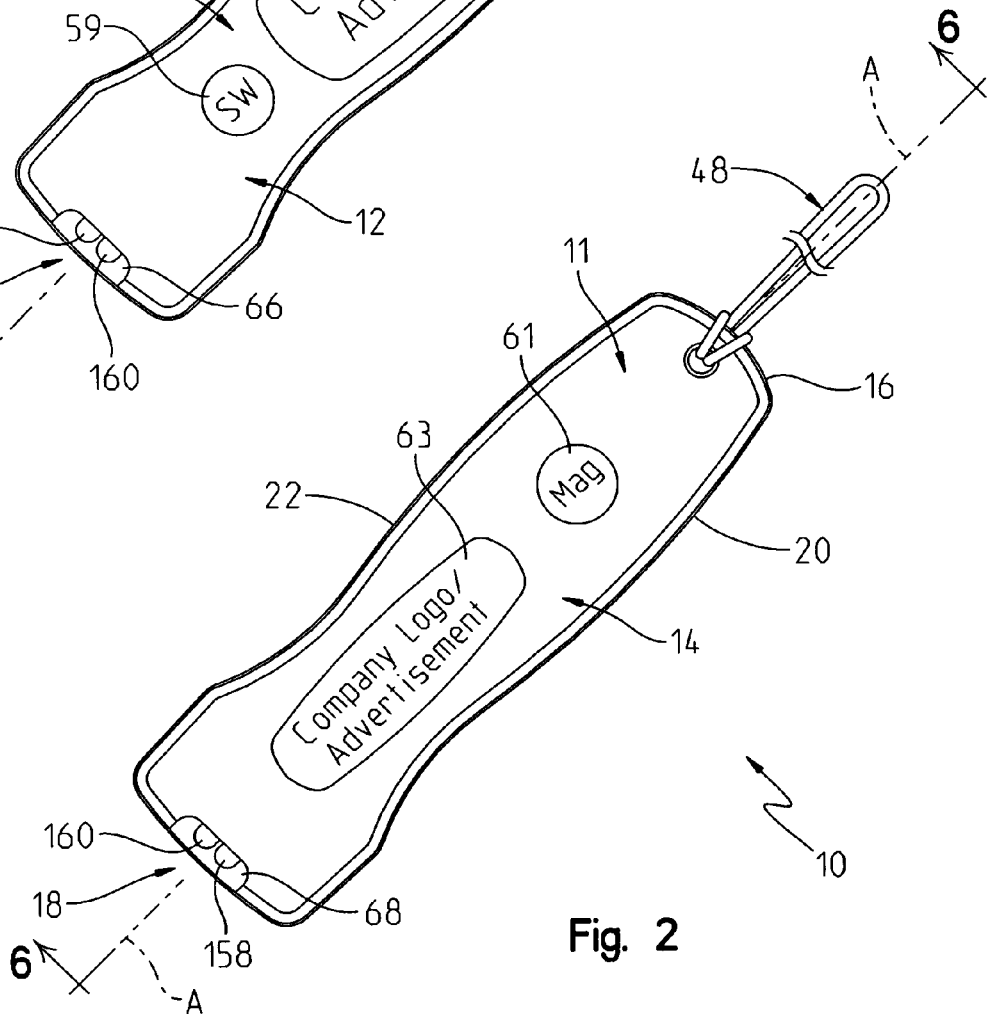
FIG. 2 is a perspective, bottom side view of the flashlight of the present invention.
Figure 3:
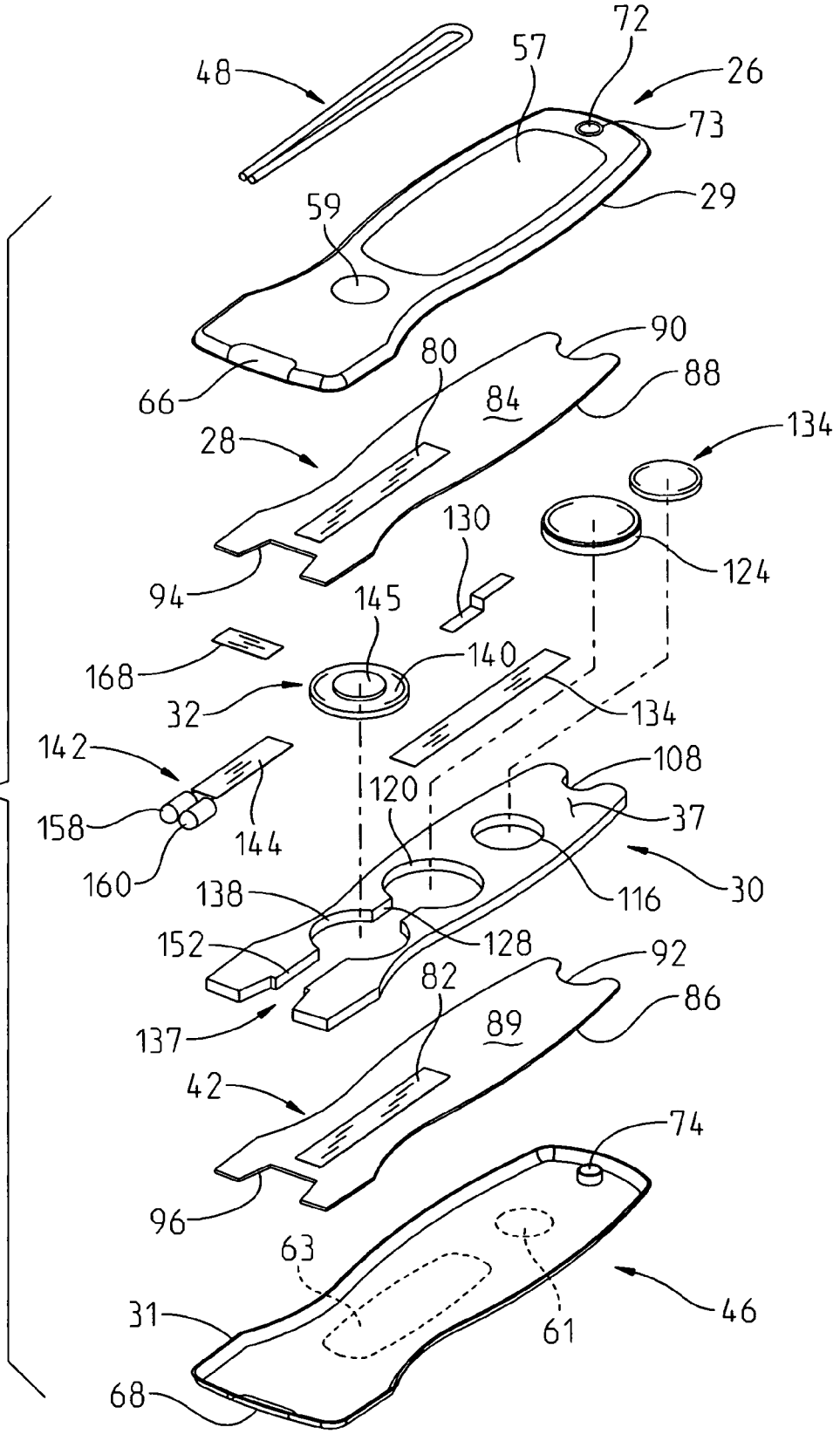
FIG. 3 is an exploded perspective view of the flashlight of the present invention.
Figure 4:
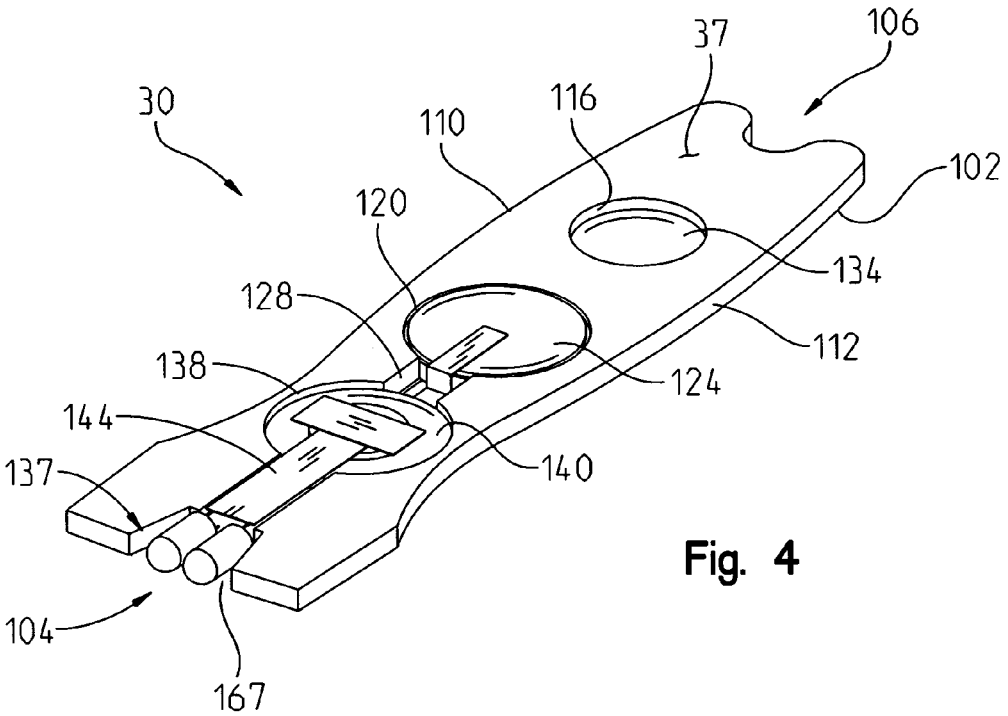
FIG. 4 is a perspective top side view of the core member and electrical components of the flashlight of the present invention.

The flashlight 10 of the present invention is shown in the drawings. Turning now to FIGS. 1-3, the flashlight 10 is shown as having a casing 11 that defines the exterior of the flashlight 10. The casing 11 includes a hollow interior cavity 17 into which the core member 30, stiffener 28, 42 and the lighting components are disposed. The casing 11 includes an upper surface 12, a lower surface 14, a proximal or base end 16, and a distal or light-containing end 18. A gripping convenience device such as a wrist strap 48 or lanyard can be coupled to the flashlight 10 in a position adjacent to the proximal end 16 of the flashlight 10. The light bulbs 158, 160 are disposed within the interior cavity 17 and are positioned adjacent to the distal or the light-containing end 18.

The casing 11 is comprised of a first, sheet-like plastic cover 26 and a second sheet-like cover member 46. Each of the first and second cover members 26, 46 include perimatral side edge surfaces 29, 31, respectively that are generally similar in size, shape and configuration so that the first and second side edge surfaces 29, 31 can be bonded together, to thereby bond together the first and second cover members to thereby form interior pocket cavity 17. The first 29 and second 31 side surfaces can be joined by heat bonding, chemical bonding (e.g. glue), sonic welding or other techniques.

The flashlight 10 preferably includes a continuous side edge surface, wherein the first 26 and second 46 cover members are coupled together. As shown in the drawings, the flashlight 10 includes a first side edge surface 20, and a second side edge surface 22.

The flashlight 10 also includes a plurality of functional components. As best shown in FIG. 3, the primary components that comprise the flashlight 10 include an upper or first cover member 26, that serves as the outer casing of the flashlight 10, along with lower cover member 46 that is preferably the mirror image of the first cover member 26. A first stiffener member 28 is disposed interiorly of the upper (first) cover member 26, and provides enhanced structural rigidity for the device. The stiffening member 28 preferably comprises a sheet of plastic, such as polypropylene, polyethylene or polystyrene, that is ideally somewhere between about 0.025 inches and 0.040 inches in thickness. The stiffener member includes a first or upper surface 84, and a second or lower surface 88.

The first stiffener member 28 extends along most of the length of the flashlight in a plane parallel with the core member 30 and the cover members 26, 46, and overlays the upper (first) surface 37 of the core member 30 so that the second surface 88 of the stiffener rests upon, and engages the upper surface 37 of the thickened core member. It should also be noted that the core member 30 has a thickness that is greater than the thickness of either the first 28 or the second 42 stiffeners.

The second stiffener 42 has a shape generally similar to the first stiffener, and includes a first or exterior facing surface 86 and a second 89 or interior facing surface. When assembled, the second stiffener 42 is sandwiched between the interior surface of the second cover member 46 and the second surface 39 of the core member 30.

A foam core member 30 is disposed interiorly of the first stiffener member 28, and is disposed generally at the center of the interior pocket or cavity 17 of the flashlight 10, between the first and second stiffeners 28, 42. The core member 30 is preferably made from foam and includes an upper or first planar surface 37, and an opposed, second or lower planar surface 39.

Each of the first stiffener 28, foam core member 30 and second stiffener 42 extend generally longitudinally along substantially the entire length of the interior cavity 17 of the flashlight 10. However, as the cover members 26, 46 encase the first stiffener 28, foam core member 30 and second stiffener 42, the first and second stiffeners 28, 42 and foam core member 30 should have a smaller length and a smaller width than the upper and lower cover members 26, 46, along with having a smaller width than the upper and lower cover members 26, 46, so that the side seam can be formed, and the upper and lower cover members 26, 46, can encase the first stiffener 28, foam core 30 and second stiffener 42 with the interior cavity 17.

Additionally, a light emitter assembly 32 is provided and includes light bulbs 156, 158, and connectors. A battery 124 is electrically coupled to the light emitter assembly 32, as will be described in more detail below. A magnet 34 is also provided and is coupled to the foam core member 30. The foam core member 30 includes a plurality of cut out portions or cavities, for serving as positioners and holders for the components of the light emitter assembly 32, battery 124 and magnet 34.

Figure 5:
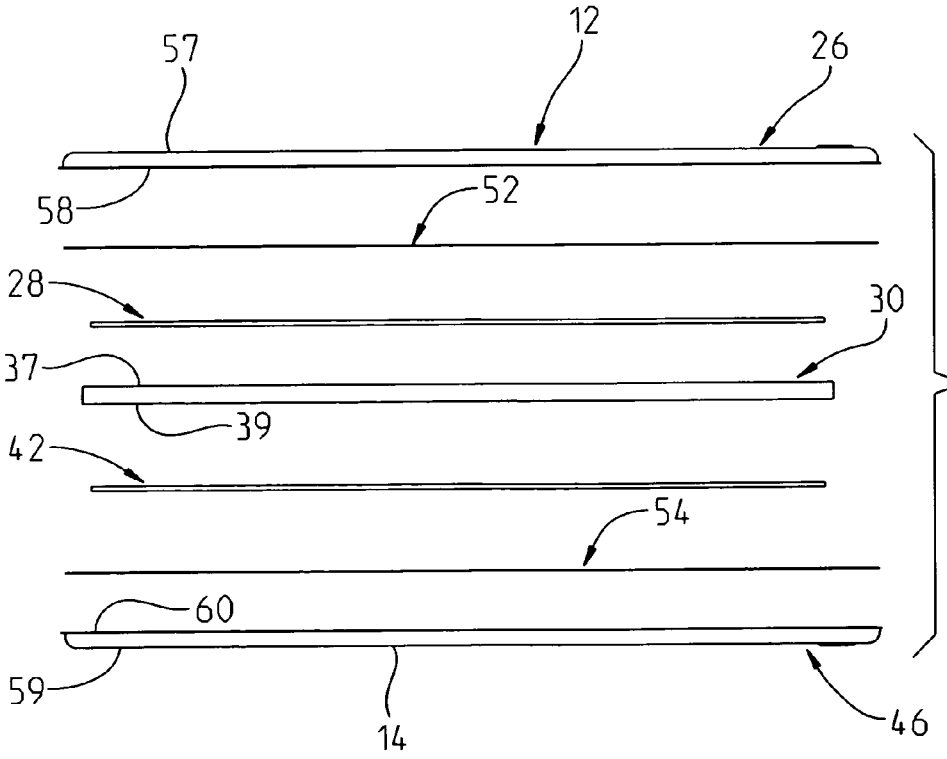
FIG. 5 is an exploded sectional view showing the various layers of materials of the present invention.
Figure 6:
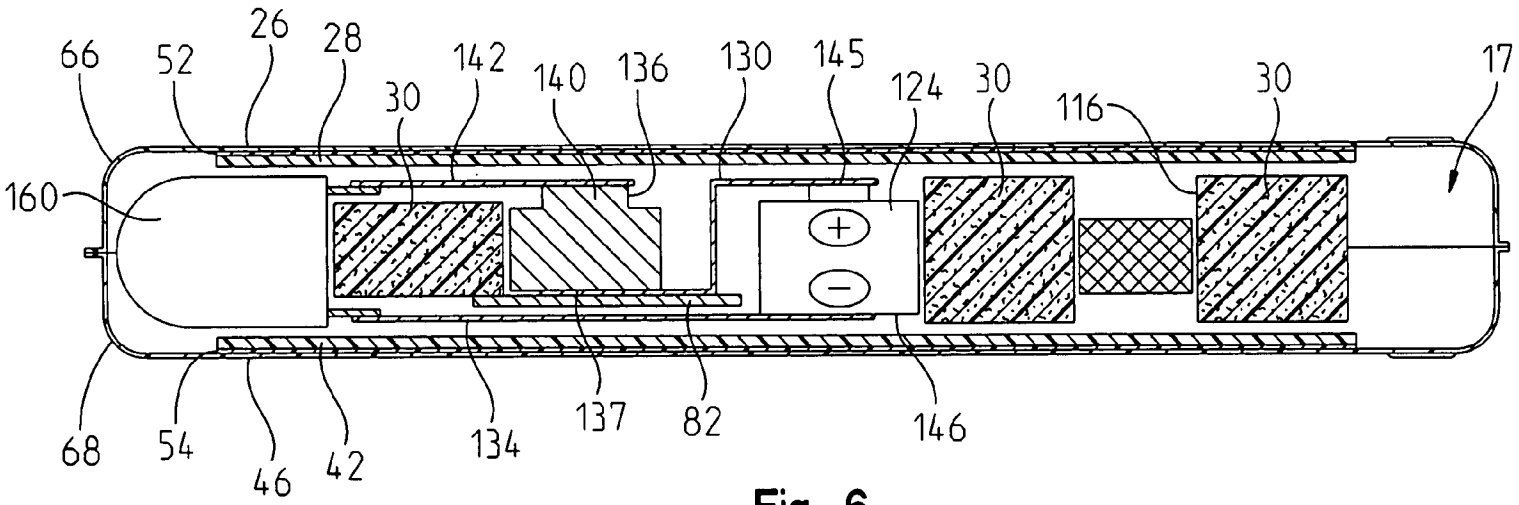
FIG. 6 is a sectional view taken along lines 6-6 of FIG. 2.

The first and second cover members 26, 46 are preferably made from a clear plastic of the type to which a printing ink can be applied so that the cover members 26, 46 can be printed. The first cover member 26 includes an exterior surface 57 and an interior surface 58. Similarly, the second cover member 46 includes an exterior surface 59 and an interior surface 60 (FIG. 5). As best shown in FIG. 5, a first layer of ink 52 is printed onto the interior surface 58, of the first cover member 26. Similarly, a layer of ink 54 is printed onto the interior surface 60 of the second, or lower cover member 46. As shown in FIGS. 1 and 2, the printing is done to impart a color to the cover of the flashlight, to hide the interior components from view and in many instances to convey a message to those who possess or see the flashlight.

One area in which the instant flashlight has special applicability is in the promotional products industry. Promotional products are products that are employed by a company as advertising vehicles for the purchasing company's products and/or services. Most promotional products bear information about a company or institution, such as a company's name, logo, etc. Promotional products are usually given to customers of the purchasing company to help the customer remember the purchasing company when making future purchasing decisions.

An example of such promotional products are coffee cups and pens that have the name of the company that purchased the coffee cups or pens on it from the actual manufacturer of the cups or pens. These name and logo containing coffee cups, pens and other products are used not to convince the public that the entity whose name is on the coffee cups or pens is either the manufacturer, distributor or seller of the coffee cup. Rather, the company whose logo is on the cups uses the coffee cups to advertise and promote their business.

One specie of promotional products are products that can be referred to as "affinity products". Affinity products are products that bear the name or logo of a party other than the manufacturer, where the name or logo of the person displayed on the product is one with whom the user of the product usually has some affinity. Examples of such affinity products are apparel items, coffee cups, furniture items, jewelry, catalogs, bar ware, die cast cars, hockey pucks, miniature sticks, and a plethora of other products that hear the name and logo of a sports team, race car team, university, high school, musical act, entertainer, or some other well known something or some one.

The ability of the surfaces, and in particular the interior surfaces 58, 60, of the covers 26, 46 to receive printing along with the generally broad flat shape of the surface that is provided by the covers 26, 46, provide wonderful vehicles to display corporate names, logos, along with sports teams names, logos and the like. Although the exterior surfaces 57, 59 of the cover members 26, 46 are also capable of receiving printing, the Applicant has found that printing on the interior surfaces 58, 60 is preferable since it is less likely to be worn off through use, and hence is more durable.

A corporate name logo area 57 is shown in the figures, to denote the place where a logo, such as a company name, company logo, sports team logo, etc., could be well placed to achieve optimum visibility, and optimum area, so that the logo can be made as large as possible and hence as prominent as possible. Along with the imprinting of the logo, functional component indicators, such as an area that is denoted by the presence of call out number 59 that denotes the presence of a switch and an area 61 that denotes the presence of a magnet 34 can also be imprinted onto the interior 58 surface of the first cover member 26, and the interior facing surface 60 of the second cover member 46. Further, a separate company logo printing can be disposed on an area 63 on the lower surface 41 of the flashlight 10.

Each of the first (upper) 26 and second (lower) 46 cover members include an unprinted, transparent area at the distal end of the flashlight. Respective unprinted areas 66, 68 are generally clear and transparent, due to the clear and transparent nature of the plastic used for the cover members 26, 46. As will be described in more detail below later, the LED light bulbs are disposed within interior cavity 17 in a position adjacent to the transparent areas 66, 68 so that the light emanating from the light bulbs can shine through the transparent area to thereby escape the interior cavity 17, and shine into the distance.

The rearward or proximal ends of each of the first and second covers 26, 46 preferably includes a grommet reinforced aperture 72, 74. The apertures 72, 74 are aligned when the device is assembled together, and reinforced with a single grommet 73. A wrist strap 48 is extended through the grommet-containing aperture 72, 74 with the ends of the wrist strap 48 tied off to form a loop, through which one can insert their hand, to place the wrist strap around one's wrist.

The first and second reinforcing stiffener members 28, 42 are generally similar in configuration. The stiffener members 28, 42 are comprised of polypropylene, polyethylene, polystyrene or some other relatively stiff sheet-like plastic, that is preferably cut to a shape similar to the shape shown for the stiffener 28, 42 in FIG. 3. The stiffeners 28, 42 are preferably somewhere between 0.025 inches and 0.045 inches thick.

Each of the stiffener members include a relatively thickened portion 80, 82. Each of the stiffener members 28, 42 also includes a relatively exteriorly disposed first surface 84, 86 and a relatively interiorly disposed second surface 88, 90. Although the thickened portion or member 80 is shown on the exteriorly disposed surface 84 of the first stiffener 28, it is preferred that the thickened portion 80 be disposed similarly to the thickened portion of stiffener 82 on the interiorly disposed surface 90 of the stiffener 86.

The thickened portions 80, 82 have a generally smaller area than the stiffener members 80, 86. The thickened portions 80, 82 are disposed on the respective surfaces 84, 90 in a position to overlay the switch member 140 and ribbon-like connectors 130, 144 that connect the switch 140, the battery 124 and the light bulbs 88.

Each of the first and second stiffeners 26, 46 includes a proximal cut out portion 90, 92 respectively, that is provided for accommodating the grommet reinforced apertures 72, 74 of the cover members 26, 46. Similarly, each of the stiffeners 28, 42 preferably includes a distal cut out portion 94, 96 for accommodating the transparent unprinted areas 66, 68 of the cover members 26, 46.

The core member 30 comprises a foam member having a thickness that is preferably as thick as the thickness of the battery 124, and is preferably thicker than either the thickness of the stiffeners 28, 42 or the cover members 26, 46. The core member 30 should have a thickness and the third cavity 120 should have a depth sufficient to enable the first and second stiffeners 28, 42 to rest upon the respective first 37 and second 39 surface of the core member 30 and extend planarly across the third cavity 12 when the battery 124 is disposed in the third cavity 120.

The foam core member 30 serves as something of a hack bone for the flashlight 10, and also serves as a component frame and positioning member for holding and positioning various members of the internal components of the flashlight 10, such as the light emitter 132, battery 124 and the magnet 34. The core member 30 includes a generally planar upper surface 37, and a generally planar lower surface 39. The core member 30 further includes a distal end 104 that is disposed adjacent to the distal end 18 of the flashlight end.

The core member 30 also includes a proximal end 106 disposed adjacent to the proximal end 16 of the flashlight 10. The proximal end 106 of the core portion 30 includes a cut out portion 108 that provides a recess for accommodating the grommet 73 containing apertures 72, 74 of the first 26 and second 42 cover portions. The core member 30 also includes a first side surface 110, and a second side surface 112.

A proximally located disc-shaped, magnet 34 receiving, fourth cut out cavity 116 is formed near the proximal end 106 of the core portion 30, and is disposed generally equidistantly between the first and second side surfaces 110, 112. The magnet-receiving fourth cavity 116 is provided for receiving magnet 34. The magnet 34 is preferably a thin, disc or coin-shaped magnet that has a diameter slightly smaller than the diameter of a dime with the diameter of the cavity 116 being slightly greater to snugly receive the dime-sized magnet 34. The flat, disc-like, dime-shaped magnet 34 is disposed against the second stiffener 42, and may be adhesively attached to the interior facing surface 89 of the second stiffener 42. The magnet 34 makes the device 10 capable of magnetically attaching to a ferromagnetic surface or object, such as a refrigerator door (not shown) or underside of a car trunk, so that the flashlight 10 can be stored in a handy position and readily available for use.

A medially disposed disc-shaped battery 124 receiving third cavity 120 is disposed in the middle portion of the core member 30 between the proximal and distal ends of the flashlight 10 and has its center point preferably positioned on the longitudinal axis A of the core member 30. The battery receiving cavity 120 is disposed generally equidistantly from the first and second side surfaces 110, 112. The battery receiving third cavity 120 is sized for interiorly snugly receiving a disc-shaped battery 124 having a size generally similar to that of a thickened coin. An example of a battery 124 that will function well is a battery 124 of the type that one might find in garage door remote control units and key fobs that are used to lock and unlock car doors. The battery 124 should have a thickness that is equal to or less than the thickness of the core member 30, so that the first and second stiffeners 26, 42 can rest upon the respective first 37, and second 39 surfaces of the core member 30, with the stiffener members 20, 42 extending planarly across the third cavity 120. Preferably, the third and fourth cavities 120, 124, along with the first 137 and second 138 cavities should extend all the way between the first 37 and second 39 surfaces of the core member 30.

Figure 7:
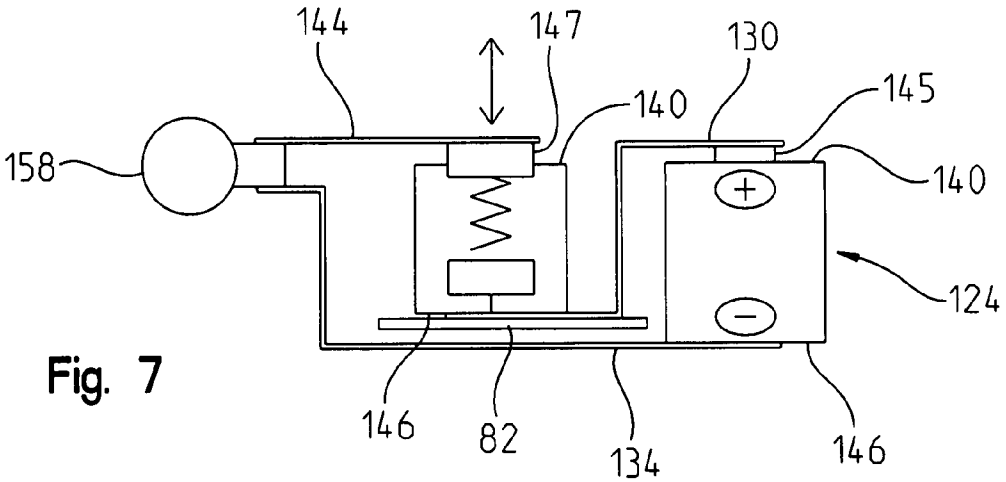
FIG. 7 is a schematic view of the battery, wiring and LEDs of the present invention.

The third cavity 120 is generally round in cross section and disc-shaped for receiving the battery 124. The disc-shaped watch or key fob battery 124 has a positive pole 145 located on one of the circular area surfaces 140, and a negative pole 146 located on the opposed circular surface, as represented schematically within FIG. 7.

A longitudinally extending medial channel 128 extends generally along the longitudinal axis of the core 30, between the third cavity 120 and the more proximally disposed switch receiving second cavity 138.

The longitudinally extending medial channel 128 is provided for housing a first ribbon-shaped electrical connector 130 that extends between the positive pole 145 of the battery 124, and the second contact 137 of the switch 140. Additionally, the medial channel 128 contains a portion of a second ribbon-shaped electrical connector 134, that extends between the negative pole 146 of the battery and the negative side of the LED light bulbs 156, 158 to complete the circuit between the light bulbs 156, 158 and the battery 124, that of course, runs through the switch 140.

The switch 140 is preferably a single pole, normally open switch, that is spring loaded, so that the switch 140 is biased normally in the open position, so that current can not flow through the switch 140 between the battery 124 and the LED light bulbs 158, 160. The switch 140 is spring loaded on-off switch that is generally disc-like in configuration and is disposed in the second cavity 138 of the core member 30. The switch 140 has an input contact 137 that is disposed adjacent to the second stiffener 42 and more particularly to the interior surface 89 of the second stiffener 42. The switch 140 also has an output contact that is disposed adjacent to the interior facing surface 88 of the first stiffener 28.

The second cavity 138 preferably extends all the way through the core member 30 between the first 37 and second 39 surfaces of the core member 30. The second cavity 130 should have a cross sectional shape similar to the switch 140 that is to be inserted into the second cavity 138. Preferably, the switch 140 used should have a thickness of slightly greater than the thickness of the core member.

The switch 140 is spring loaded so that depression of the switch closes the switch, to allow current to flow from the battery 124 to the LED light bulbs 158 and 160. Upon release of pressure from the switch 140, the switch 140 is urged by the spring (not shown) to move into the open position wherein current can no longer flow between the battery 124 and the LED lights 158, 160.

Alternately, the switch 140 can be a detent switch wherein the switch 140 is moved from a deactivated (open) position to an activated (closed) position and remains in the closed position even when pressure is released from the switch 140. A second exertion of pressure on the switch 140 then moves the switch 140 from the closed position to the reopened position. Although such a switch does have the benefit of enabling the user to keep the light glowing while removing pressure from the switch 140, it also has the drawback of increasing the likelihood that the light will be turned on or remain on inadvertently which wears out the battery much more quickly than one might prefer.

Since the flashlight 10 design of the present invention does not easily permit removal and replacement of the battery 124, it is believed that the preferable design is the one described above wherein the switch must be depressed in order to allow the circuit to be closed to permit the light 158, 160 to be turned on, and wherein the removal of force from the switch 140 causes the switch 140 to move, under the influence of a spring to the open position thereby causing the light to turn off.

The distal portion of the core member 30 includes a first axially extending distal leg 161, and a second axially extending distal leg 163 that define a first cavity 137 in which the light emitting LED bulbs 158, 160 are disposed. The first cavity includes a distal opening that is defined by the open space 167 between the distal ends of the first 161 and second 163 axially extending distal legs. The longitudinally extending distal first cavity 137 includes side walls 152 that help define the cavity 137. The first cavity channel 137 is formed to extend between second switch receiving cavity 138 and the distal end of the core portion 30. This distal first cavity 137 is provided for housing a portion of the light emitter assembly 142. The light emitter assembly 142 includes first and second LED bulbs 158, 160 in the embodiment shown. It will be appreciated that the particular type and number of LEDs used is something of a matter of choice, depending upon factors such as current draw, useful life time, and lumens that one desires to achieve when constructing the flashlight.

A third ribbon-shaped electrical conductor 144 extends between the output contact of the switch 140, and one contact 147 of the LED lights 158, 160. The third ribbon conductor 144 conducts current from the switch 140, and hence from the battery 124, to the LED lights 158, 160, so that when the switch 140 is closed, current will flow from the battery 124, through the switch 140 and through ribbon-shaped conductor 144 and into the LED lights 158, 160. The distal end of the ribbon connector 144 is preferably soldered to the LED lights 158, 160. The tape member 168 can adhesively join and secure the ribbon-like connector 144 to the output contact 136 of the switch 140. Each of the ribbon conductor cables 130, 134, 144 are preferably made from a rectangular ribbon shaped therein and bendable conductive metal strip, such as a copper, steel, silver, gold, nickel, brass, bronze or lead. Optimally, the strip comprises a thickened foil strip.

It will also be noted that the circuit between the LED lights 158, 160 and the battery 124 is completed by ribbon connecter cable 130 that couples the negative pole 146 of the battery 124 to the second pole of the LED lights 158, 160. An insulator, such as a portion of the second stiffener 82 or a plastic sheet should be placed between ribbon-like electrical connector 134 and ribbon-like electrical connector 130 to prevent the two ribbon connectors 134, 130 from coming into electrical contact and possibly short-circuiting.

The device 10 is assembled, as shown in FIG. 1. The components are placed in their appropriate array, and a radio frequency bonding technique is used to bond the side edges of the cover members 26, 46 together, thus forming a flashlight 10 similar to that shown in FIGS. 1 and 2. The flashlight 10 is both light weight, and inexpensive to manufacture. Additionally, because of the LED lights 158, 160, the flashlight 10 is capable of producing a relatively large amount of light with a relatively small amount of current draw. Further, through the use of flat ribbon-shaped electrical connectors, the device 10 can be easily manufactured, and does not have any annoying bumps or humps as would exist when one uses regular round wires.

Additionally, the use of the first and second stiffeners 28, 42 provides a structural rigidity, that helps to prevent the flashlight from being bent, especially around an axis that is generally perpendicular to the longitudinal axis A of the flashlight 10. This extra stiffening provides the flashlight 10 with a better feel, and makes its operation more simple, by enabling the switch to be able to be better actuated for easily and more efficiently actuated.

Having described the invention in detail with reference to certain preferred embodiments, it will be appreciated that variations and modifications exist within the scope and spirit of the present invention, and that the invention should not be limited to the embodiment shown herein, but rather, should be expanded to include all variations, modifications and equivalents contained within the scope and spirit of the invention, and the claims appended hereto.

What is claimed:

1. A flashlight comprising a flexible foam core member including a first surface, a second surface, a side edge portion, a proximal end and a distal end, a first cavity, a second cavity and a third cavity, and a longitudinally extending passageway extending between the second and third cavities, a plurality of light generating components including a light emitter disposed in the first cavity, a switch disposed in the second cavity and a battery disposed in the third cavity, and a plurality of non-rigid manually shapeable metal foil ribbon cables for electrically coupling the light emitter, switch and battery, the passageway being configured for receiving at least one of the ribbon cables, a first sheet stiffener for overlaying the first surface of the core member, a first cover sheet member for overlaying the first sheet stiffener to sandwich the first sheet stiffener between the first surface of the core member and the first cover, a second cover sheet member for overlaying the second surface of the core member, wherein the first and second cover sheet members are joined together to form a flexible casing having an interior cavity wherein the core member, stiffener and light generating components are disposed within the interior cavity of the flashlight.

2. The flashlight of claim 1 wherein the core member has a thickness, the battery has a thickness, and wherein the thickness of the core member is generally at least as great as the thickness of the battery, and wherein the third cavity has a diameter sized to snugly receive the battery.

3. The flashlight of claim 1 wherein the core member includes a longitudinal passageway extending between the first cavity and the second cavity, the third cavity has a depth, the battery has a thickness, and wherein the depth of the third cavity is generally at least as great as the thickness of the battery.

4. The flashlight of claim 3 wherein at least one of the first, second and third cavities extend completely through the core member between the first and second surfaces, and wherein the second and third cavities have diameters sized to snugly receive the switch and the battery.

5. The flashlight of claim 3 wherein each of the first, second and third cavities extend completely through the core member between the first and second surfaces; and the core member is comprised of a foam material and wherein the core member has a thickness and the depth of the third cavity is sufficient to enable the stiffener to rest on the first surface of the core member and extend planarly across the third cavity wherein the battery is inserted into the third cavity.

6. The flashlight of claim 3 wherein the core member has a thickness the first surface of the core member is generally planar and the stiffener is substantially a sheet, and the depth of the third cavity is sufficient to permit the first stiffener to rest upon the first surface of the core member and planarly extend over the third cavity wherein the battery is disposed in the third cavity.

7. The flashlight of claim 6 wherein the core member includes a first axially extending distal leg, a second axially extending distal leg and a distal opening disposed between the first and second distal legs, in which at least a portion of the light emitter is disposed.

8. The flashlight of claim 7 wherein the light emitter comprises an LED bulb, and wherein the LED is disposed in the distal opening between the first and second distal legs, and wherein at least one of the first and second cover sheet members includes a printed area on which a message or component indicator is printed, and a transparent portion disposed adjacent the distal opening for permitting light from the LED to pass out of the interior of the casing.

9. The flashlight of claim 7 wherein the core member includes a fourth cavity, further comprising a magnet disposed in the fourth cavity.

10. The flashlight of claim 9 wherein the plurality of non-rigid manually shapeable metal foil ribbon cables comprises elongated, ribbon-shaped, non-rigid strips of metal foil.

11. The flashlight of claim 1 wherein the plurality of shapeable metal foil ribbon cables comprise a plurality of elongated ribbon-shaped, non-rigid strips of shapeable metal foil.

12. The flashlight of claim 1 wherein the plurality of non-rigid, manually shapeable metal foil ribbon cables comprises a first non-rigid ribbon cable of bendable metal foil extending between and electrically coupling the battery and the switch, a second non-rigid ribbon cable of metal foil extending between and electrically coupling the battery and the light emitter, a third non-rigid ribbon cable of metal foil that extends between and electrically couples the switch and the light emitter.

13. The flashlight of claim 12 further comprising a tape member for mechanically coupling the first non-rigid ribbon of manually shapeable metal foil to the battery.

14. The flashlight of claim 1 wherein the core member has a thickness and the third cavity has a depth sufficient to enable the first stiffener to rest upon the first surface of the core member and extend planarly across the third cavity when the battery is disposed in the third cavity.

15. The flashlight of claim 14 further comprising a second sheet stiffener overlaying the second surface of the core member, wherein the thickness of the core and the depth of the third cavity are sufficient to enable the second stiffener to rest upon the second surface of the core member and extend planarly across the third cavity wherein the battery is disposed in the third cavity.

16. The flashlight of claim 1 wherein the core member includes a first axially extending distal leg, a second axially extending distal leg and a distal opening disposed between the first and second distal legs, in which at least a portion of the light emitter is disposed, and wherein the core member includes a fourth cavity, further comprising a magnet disposed in the fourth cavity for permitting the flashlight to be magnetically coupled to a ferromagnetic material.

17. A flashlight comprising a flexible foam core member including a first surface, a second surface, a side edge portion, a proximal end and a distal end, a first cavity, a second cavity and a third cavity, and a longitudinally extending passageway extending between the second and third cavities, a plurality of light generating components including a light emitter disposed in the first cavity, a switch disposed in the second cavity and a battery disposed in the third cavity, and a plurality of non-rigid, manually shapeable metal foil cable strips for electrically coupling the light emitter, switch and battery, the passageway being configured for receiving at least one of the ribbon cables, a first sheet stiffener for overlaying the first surface of the core member, wherein the core member has a thickness the first surface of the core member is generally planar and the first sheet stiffener is substantially a sheet, and the third cavity has a depth that is sufficient to permit the first sheet stiffener to rest upon the first surface of the core member and planarly extend over the third cavity wherein the battery is disposed in the third cavity, a first cover sheet member for overlaying the first sheet stiffener to sandwich the first sheet stiffener between the first surface of the core member and the first cover, a second cover sheet member for overlaying the second surface of the core member, wherein the first and second cover sheet members are joined together to form a flexible casing having an interior cavity wherein the core member, stiffener and light generating components are disposed within the interior cavity of the flashlight and wherein each of the first and second cover sheet members includes a printed area on which a message or component indicator is printed, and a transparent portion disposed adjacent the distal opening for permitting light from the LED to pass out of the interior of the casing.

18. The flashlight of claim 17 wherein the plurality of non-rigid manually shapeable ribbon cables of metal foil comprises a first non-rigid, manually shapeable ribbon cable strip of metal foil extending between and electrically coupling the battery and the switch, a second non-rigid, manually shapeable ribbon cable strip of metal foil strip extending between and electrically coupling the battery and the light emitter, a third non-rigid, manually shapeable ribbon cable strip of metal foil extending between and electrically couples the switch and the light emitter.

19. A flashlight comprising a flexible foam core member including a first surface, a second surface, a side edge portion, a proximal end and a distal end, a first cavity, a second cavity and a third cavity, a longitudinal passageway extending between the first cavity and the second cavity; and a longitudinally extending passageway extending between the second cavity and the third cavity;

a plurality of light generating components including a light emitter disposed in the first cavity, a switch disposed in the second cavity and a battery disposed in the third cavity, and a plurality of non-rigid, manually shapeable metal foil cable strips for electrically coupling the light emitter, switch and battery, at least one of the passageways being configured for receiving at least one of the ribbon cables, a first sheet stiffener for overlaying the first surface of the core member, wherein the core member has a thickness the first surface of the core member is generally planar and the first sheet stiffener is substantially a sheet, and the third cavity has a depth that is sufficient to permit the first sheet stiffener to rest upon the first surface of the core member and planarly extend over the third cavity wherein the battery is disposed in the third cavity, a first cover sheet member for overlaying the first sheet stiffener to sandwich the first sheet stiffener between the first surface of the core member and the first cover, a second cover sheet member for overlaying the second surface of the core member, wherein the first and second cover sheet members are joined together to form a flexible casing having an interior cavity wherein the core member, stiffener and light generating components are disposed within the interior cavity of the flashlight and wherein each of the first and second cover sheet members includes a printed area on which a message or component indicator is printed, and a transparent portion disposed adjacent the distal opening for permitting light from the LED to pass out of the interior of the casing.

* * * * *